US009164436B2

(12) United States Patent
Kurita et al.

(10) Patent No.: US 9,164,436 B2
(45) Date of Patent: Oct. 20, 2015

(54) FIXING DEVICE AND IMAGE FORMING APPARATUS

(71) Applicant: FUJI XEROX CO., LTD., Tokyo (JP)

(72) Inventors: Atsumi Kurita, Kanagawa (JP); Masayo Higashimura, Kanagawa (JP); Yutaka Kiuchi, Kanagawa (JP); Kunihiko Sato, Kanagawa (JP); Sakon Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/206,068

(22) Filed: Mar. 12, 2014

(65) Prior Publication Data

US 2015/0030343 A1 Jan. 29, 2015

(30) Foreign Application Priority Data

Jul. 25, 2013 (JP) ..... 2013-154459

(51) Int. Cl.
*G03G 15/20* (2006.01)

(52) U.S. Cl.
CPC ..... *G03G 15/2028* (2013.01); *G03G 15/2017* (2013.01); *G03G 15/2046* (2013.01); *G03G 15/2064* (2013.01); *G03G 2215/2045* (2013.01)

(58) Field of Classification Search
CPC ..... G03G 15/2003; G03G 15/2064; G03G 15/2078; G03G 15/2017; G03G 15/2045
USPC ..... 399/67
See application file for complete search history.

(56) References Cited

U.S. PATENT DOCUMENTS

2008/0181623 A1* 7/2008 Hasegawa ..... 399/13

FOREIGN PATENT DOCUMENTS

JP A-61-231577 10/1986

* cited by examiner

*Primary Examiner* — David Bolduc
*Assistant Examiner* — Barnabas Fekete
(74) *Attorney, Agent, or Firm* — Oliff PLC

(57) ABSTRACT

A fixing device includes a fixing section that includes rotatable members arranged to form a nip area through which a strip-shaped medium passes, and heaters that heat the rotatable members; and a control section. The fixing section applies heat and pressure to a toner image that is formed on the medium and passes through the nip area via the rotatable members heated by the heaters to fix the toner image onto the medium. The control section performs such control that the rotation of the rotatable members is stopped when the temperature of contact portions of the rotatable members that are in contact with the medium is lower than or equal to a first temperature that is lower than a temperature at which a portion of the medium softens.

15 Claims, 12 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2013-154459 filed Jul. 25, 2013.

BACKGROUND

Technical Field

The present invention relates to a fixing device and an image forming apparatus.

SUMMARY

According to an aspect of the invention, there is provided a fixing device including a fixing section that includes rotatable members arranged to form a nip area through which a strip-shaped medium passes, and heaters that heat the rotatable members; and a control section. The fixing section applies heat and pressure to a toner image that is formed on the medium and passes through the nip area via the rotatable members heated by the heaters to fix the toner image onto the medium. The control section performs such control that the rotation of the rotatable members is stopped when the temperature of contact portions of the rotatable members that are in contact with the medium is lower than or equal to a first temperature that is lower than a temperature at which a portion of the medium softens.

According to the above aspect, a situation where a portion of a medium softens, peels off, and then adheres to a part of the media where a toner image is to be formed, due to the heat of the rotatable member stopped upon the completion of the fixing of a toner image, is less likely to occur than in a case where the control of the fixing device, as in the present invention, is not performed.

BRIEF DESCRIPTION OF THE DRAWINGS

Exemplary embodiments of the present invention will be described in detail based on the following figures, wherein.

DETAILED DESCRIPTION

[1] First Exemplary Embodiment

[1-1] Hardware Configuration

Figure 1:
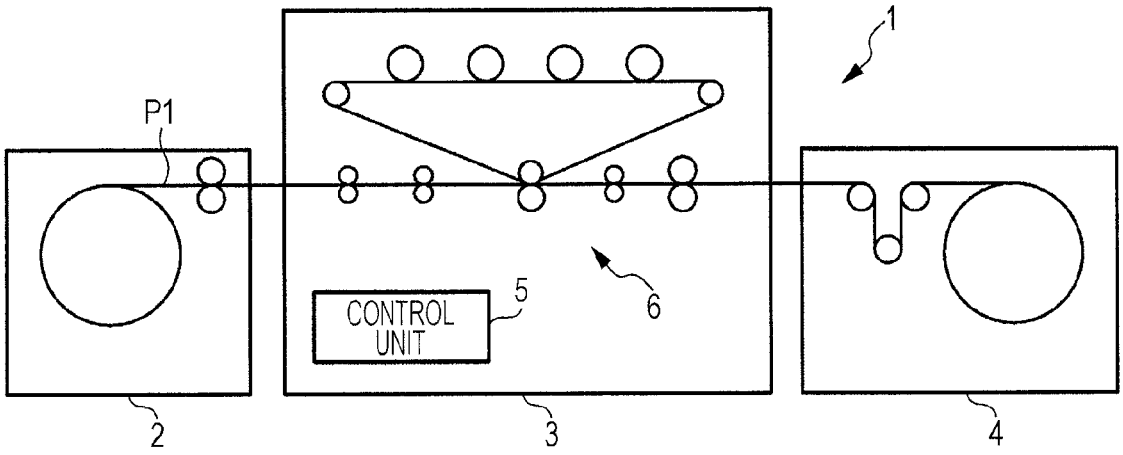
FIG. 1 is a diagram showing an exemplary hardware configuration of an image forming system according to the first exemplary embodiment.

FIG. 1 is a diagram showing an exemplary hardware configuration of an image forming system according to a first exemplary embodiment. FIG. 1 shows an image forming system 1 including a paper feed unit 2, an image forming apparatus 3, and a post-processing unit 4. The paper feed unit 2 supplies a medium P1 to the image forming apparatus 3, and the image forming apparatus 3 forms an image on the supplied medium P1 using an electrophotographic system. The post-processing unit 4 performs post-processing, such as taking up of the medium P1 with the image formed thereon.

The medium P1, which is also called "continuous paper", is a strip-shaped sheet medium elongated in the direction in which it is transported (hereinbelow, "transport direction"). The medium P1, in the form of a single continuous medium, is transported from a place where it is fed (paper feed unit 2) to a place where it is stored (post-processing unit 4) after an image is formed thereon. While the medium P1 is transported, the image forming apparatus 3 continuously forms an image. In this exemplary embodiment, the outer surfaces of the medium P1 are coated with a coating material. This coating may soften and peel off when heated to or above a certain temperature. Details of the softening and peeling will be described below.

The image forming apparatus 3 includes a control unit 5 and an image forming section 6. The control unit 5 includes a central processing unit (CPU), a read only memory (ROM), a random access memory (RAM), and a real-time clock. The control unit 5 controls the operation of the respective units due to the CPU executing programs stored in the ROM or a storage portion using the RAM as a work area. The real-time clock calculates the current date and time and notifies the CPU thereof. The control unit 5 includes a hard disk etc. that stores data and programs used by the CPU for control. The control unit 5 is connected to an external unit via a network (not shown). When receiving image data from the external unit, the control unit 5 controls the paper feed unit 2, the image forming apparatus 3, and the post-processing unit 4 to perform image forming processing, in which an image is formed on a medium P1 according to the image data. The image forming system 1 is a computer that processes image information using the CPU. The image forming section 6 will be described below with reference to FIG. 2.

Figure 2:
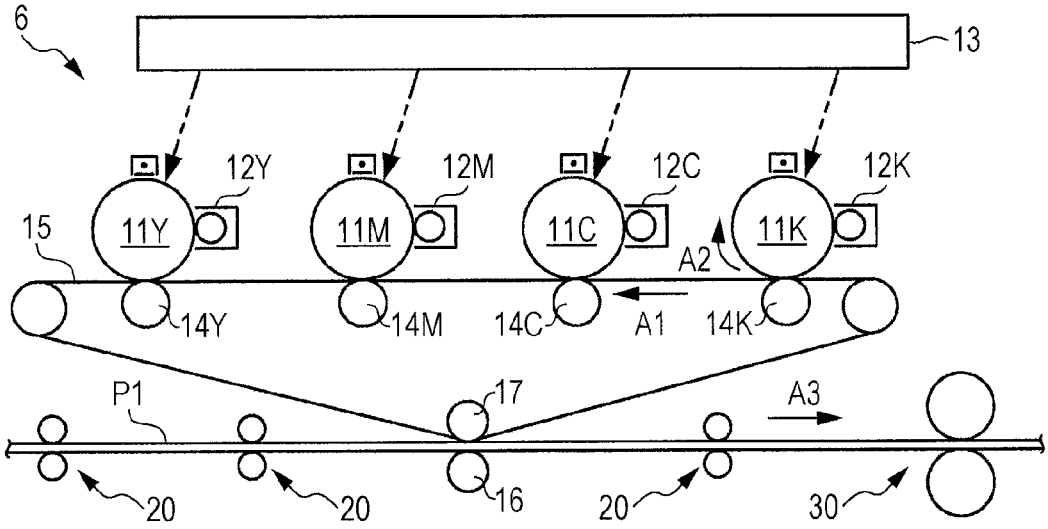
FIG. 2 is a diagram showing an exemplary hardware configuration of the image forming apparatus.

FIG. 2 is a diagram showing an exemplary hardware configuration of the image forming section 6. The image forming section 6 forms a color image by fixing four colors of toner, i.e., yellow (Y), magenta (M), cyan (C), and black (K), on a recording medium, such as a sheet. The image forming section 6 accommodates a photoconductor drum 11, a charging unit, a developing unit 12, and a first-transfer roller 14 for each color. These units are arranged along an intermediate transfer belt 15, in the order of Y, M, C, and K in an arrow A1 direction. In FIG. 2, the reference numeral of each unit is accompanied by an alphabet (Y, M, C, or K) at the end thereof, showing that the unit is used to form an image corresponding to the color denoted by the alphabet. The alphabets at the end of the reference numerals will be omitted where distinction is not needed.

Each photoconductor drum 11 is rotated in an arrow A2 direction and carries an electrostatic latent image and toner image formed on the surface thereof. The surface of the photoconductor drum 11 is charged to a predetermined electric potential by the charging unit. An exposure unit 13 irradiates (exposes) the surface of the charged photosensitive layer with (to) light (exposure light) that is controlled in intensity and irradiation position in accordance with the above-described image data to form an electrostatic latent image expressing an image indicated by the image data. The developing unit 12 supplies developer containing charged toner to the photoconductor drum 11 to develop the electrostatic latent image into a toner image. The first-transfer roller 14 is provided so as to face the photoconductor drum 11 with the intermediate transfer belt 15 therebetween. A voltage applied to the first-transfer roller 14 and the photoconductor drum 11 causes an electric potential difference between the photoconductor drum 11 and the intermediate transfer belt 15, causing the charged toner to move to the intermediate transfer belt 15 (first-transfer).

The intermediate transfer belt 15 is an endless belt that carries the toner image first-transferred thereto. The intermediate transfer belt 15 is supported by multiple support rollers in such a manner that it is rotated in the arrow A1 direction by a driving force applied thereto. K, C, M, and Y toner images are sequentially first-transferred from the photoconductor drums 11 to the intermediate transfer belt 15. The second-transfer roller 16 and the backup roller 17 are provided so as to face each other with the intermediate transfer belt 15 therebetween, forming a nip.

Transport rollers 20 transport the medium P1 in a transport direction A3, in cooperation with the paper feed unit 2 and the post-processing unit 4 shown in FIG. 1. The paper feed unit 2, the transport rollers 20, and the post-processing unit 4 are an example of a transport section that transports the medium P1. The transport rollers 20 transport the medium P1 to the nip. The medium P1 comes into contact with the intermediate transfer belt 15 at the nip. A voltage is applied to the second-transfer roller 16 so as to generate an electric potential difference between the second-transfer roller 16 and the backup roller 17, causing the toner image to be second-transferred from the intermediate transfer belt 15 to the medium P1. In this manner, the toner image is formed on the medium P1. The photoconductor drum 11, the exposure unit 13, the developing unit 12, the first-transfer roller 14, the intermediate transfer belt 15, the second-transfer roller 16, and the backup roller 17 form a toner image on a medium transported by the transport device and are an example of a "forming section" of the present invention.

The fixing unit 30 is an example of a fixing section that fixes a toner image formed on a medium P1 to the medium P1.

Figure 3:
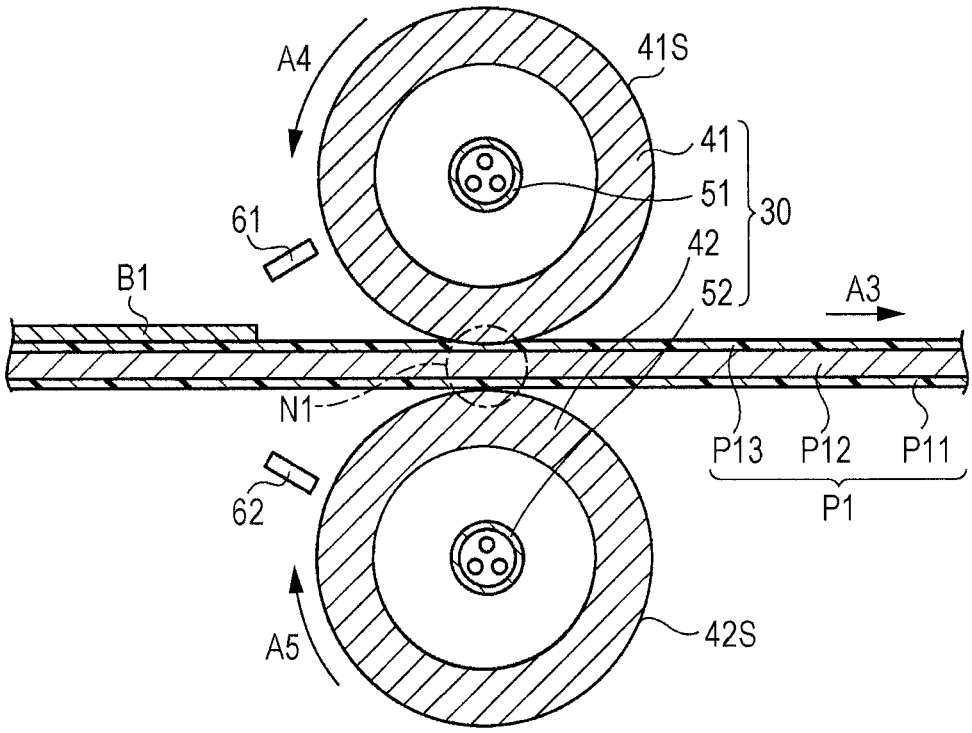
FIG. 3 is an enlarged view of a fixing unit.

FIG. 3 is an enlarged view of the fixing unit 30 shown in FIG. 2. The fixing unit 30 includes rotatable members 41 and 42 (hereinbelow, collectively referred to as "rotatable members 40" where distinction is not needed) and heaters 51 and 52 (hereinbelow, collectively referred to as "heaters 50" where distinction is not needed). The rotatable members 41 and 42 are cylindrical members (rollers) that are rotated about cylindrical shafts. The rotatable members 41 and 42 are supported so as to nip the medium P1 therebetween. The rotatable member 41 is rotated in a rotation direction A4 indicated by the corresponding arrow, and the rotatable member 42 is rotated in a rotation direction A5 indicated by the corresponding arrow, thereby transporting the medium P1 in the transport direction A3. The rotatable members 41 and 42 form a nip area N1, through which the medium P1 passes during transportation.

The rotatable members 41 and 42 are urged against each other by springs or the like (not shown) to apply pressure to the medium P1 and a toner image (toner image B1 in an example of FIG. 3) formed on the medium P1, which pass through the nip area N1. The rotatable members 41 and 42 have the heaters 51 and 52 therein. The heaters 51 and 52 heat the rotatable members 41 and 42, respectively, with, for example, halogen lamps that generate heat when powered.

The fixing unit 30 applies heat and pressure to the toner image B1, which is formed on, for example, the medium P1 and passes through the nip area N1, via the rotatable members 40 heated with the heaters 50 to fix the toner image B1 to the medium P1. At this time, the rotatable members 40 are heated by the heaters 50 such that the temperature of the surfaces thereof (hereinbelow, "surface temperature") is maintained at a temperature required to fix the toner image B1 (hereinbelow, "fixing temperature"). Because the heating with the heaters 50 stops upon the completion of the fixing, the surface temperature of the rotatable members 40 gradually decreases to a temperature corresponding to the environmental temperature.

The medium P1 has softenable layers P11 and P13 (hereinbelow, collectively referred to as "softenable layers P10" where distinction is not needed) on the outer surfaces, and a sheet member P12 interposed therebetween. The sheet member P12 is a strip-shaped sheet member made of paper, film, polyethylene terephthalate (PET), or the like. The softenable layers P10 are made of, for example, resin and coat the sheet member P12. The softenable layers P10 may soften at a certain temperature (hereinbelow, "softening temperature") lower than or equal to the fixing temperature.

As mentioned above, because the medium P1 is continuous from the paper feed unit 2 to the post-processing unit 4, a portion thereof is still located in the nip area N1 after the fixing. In this exemplary embodiment, the fixing unit 30 does not have a separating device that separates the rotatable members 40 and the medium P1 (or, that brings the rotatable members 40 and the medium P1 out of contact with each other). Hence, the rotatable members 40 are kept in contact with the medium P1 even when the medium P1 is not transported because no image forming operation is performed.

Also shown in FIG. 3 are temperature sensors 61 and 62 (hereinbelow, collectively referred to as "temperature sensors 60" where distinction is not needed) that are used to measure the temperatures of surfaces 41S and 42S of the rotatable members 41 and 42, respectively. The temperature sensors 60 are, for example, radiation thermometers, which measure the temperature of a surface of an object without touching it, and supply temperature data indicating the measured temperatures of the surfaces (41S and 42S) to the control unit 5 shown in FIG. 1. The temperature sensors 60 supply the temperature data to the control unit 5 every predetermined time (for example, every 0.1 second). The temperature sensors 60 are provided on the upstream side of the nip area N1 in the rotation direction (A4 or A5) and measure the temperatures of the surfaces of the rotatable members immediately before arriving at the nip area N1.

[1-2] Functional Configuration

As has been described above, the medium P1 has the softenable layers P10 on the outer surfaces thereof. Let us assume that the softening temperature of the medium P1 is X° C. (for example, 100° C.), and the surface temperature of the rotatable members 40 when fixing toner images, i.e., the fixing temperature, is Y° C. (for example, 180° C.). In this exemplary embodiment, X° C. is lower than Y° C. Hence, a portion (more specifically, the softenable layers P10) of the medium P1 may be softened by the heat remaining in the rotatable members 40 stopped upon the completion of the fixing of a toner image and adhere to the surfaces of the rotatable members 40. The image forming system 1 performs adhesion prevention processing to prevent such a situation using the above-described hardware configuration. The control unit 5 controls the respective units through the execution of the programs to achieve the following functions.

Figure 4:
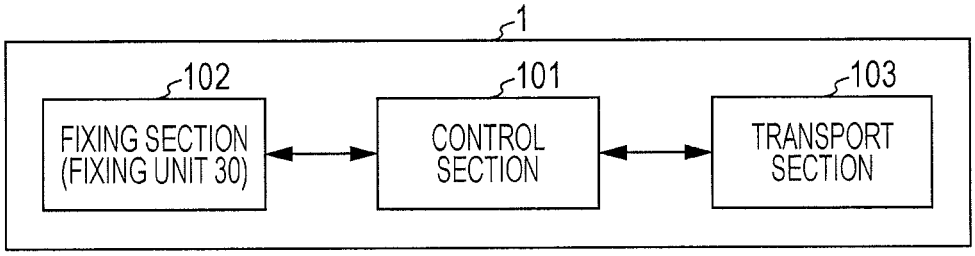
FIG. 4 is a diagram showing an exemplary functional configuration of the image forming system.

FIG. 4 is a diagram showing an exemplary functional configuration of the image forming system 1. The image forming system 1 includes a control section 101, a fixing section 102, and a transport section 103. The transport section 103 is a function achieved by the paper feed unit 2, the transport rollers 20, and the post-processing unit 4 and transports a strip-shaped medium. The fixing section 102 is a function achieved by the fixing unit 30 and fixes a toner image formed on the strip-shaped medium and passing through the nip area N1 onto the medium.

The control section 101 is an example of a section that controls the fixing section 102 so as to perform an operation (hereinbelow, "suppressing operation") for preventing a portion of the medium P1 from softening, peeling off, and adhering to the rotatable members 40 due to the heat of the rotatable members 40 stopped upon the completion of the fixing.

In this exemplary embodiment, the control section 101 stops the rotation of the rotatable members 40 when the temperature of portions (hereinbelow, "contact portions") of the rotatable members 40 that are in contact with the medium P1 is lower than or equal to a certain temperature (hereinbelow, a "first temperature"). The contact portions are portions of the surfaces of the rotatable members 40 that are in contact with the medium P1 in the nip area N1. Because the control section 101 stops the rotation of the rotatable members 40 in this manner, the medium P1 is less likely to soften and a portion of the softened medium P1 is less likely to adhere to the rotatable members 40 than in a case where the rotation of the rotatable members 40 is stopped when the temperature of the contact portions is higher than the first temperature. The operation of stopping the rotation of the rotatable members 40 by the control section 101 in this way is the above-described suppressing operation. More specifically, the control section 101 stops the rotation of the rotatable members 40 by using a temperature below the above-mentioned softening temperature (temperature at which the softenable layers P10 of the medium P1 soften) as the first temperature. The control section 101 also controls the transport section 103, in addition to the fixing section 102. For example, the control section 101 reduces the speed at which the medium is transported (hereinbelow, "transport speed") after the toner image is fixed onto the medium.

The control section 101 is a function achieved by the control unit 5 and the temperature sensors 60. The control unit 5 controls the transport section 103 to transport the medium at varying transport speeds. The control unit 5 calculates, from, for example, the transport speed and the time of the last emission of the exposure light from the exposure unit 13 according to image data instructing the formation of an image, the time when the fixing of the toner image according to the image data is completed. It is also possible that a sensor for detecting an image is provided on the downstream side of the nip area N1 in the transport direction to enable the control unit 5 to obtain the time of the completion of the fixing on the basis of the data showing the detection results of the sensor.

When the time of the completion of the fixing has passed, the control unit 5 determines that the fixing of the toner image on the medium P1 has been completed and then reduces the transport speed by controlling the transport section 103. When, for example, the transport speed may be varied across ten levels, the control unit 5 reduces the transport speed by one level every 10 seconds. The control unit 5 stores Z° C. (for example, 80° C.), which is lower than the softening temperature X° C. (for example, 100° C.) (X>Z), as the first temperature. It is desirable that Z° C. be in such a temperature range in which the surface temperature of the rotatable members 40 falls after heating by the heaters 50 is stopped.

When the time of the completion of the fixing has passed, the control unit 5 determines if the temperature indicated by the supplied temperature data is lower than or equal to the first temperature every time when the temperature data is supplied by the temperature sensors 60. When it is determined that the temperature is lower than or equal to the first temperature, the control unit 5 stops the rotation of the rotatable members 40 by controlling the fixing section 102. At the same time, the control unit 5 stops the transportation of the medium P1 by controlling the transport section 103.

[1-3] Operation

The image forming system 1 performs the above-described adhesion prevention processing (processing for preventing a portion of the softened medium from adhering to the rotatable members), using the above-described configuration.

Figure 5:
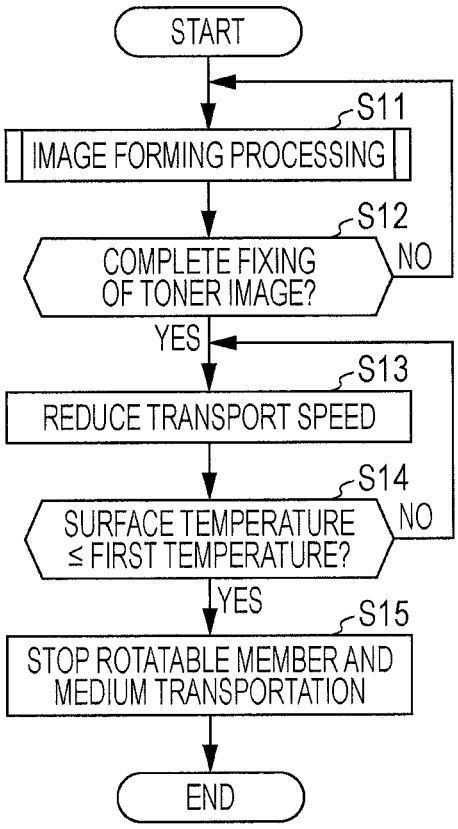
FIG. 5 is a flowchart showing an exemplary operation of the image forming system in adhesion prevention processing.

FIG. 5 is a flowchart showing an exemplary operation of the image forming system 1 in the adhesion prevention processing. First, the image forming system 1 performs image forming processing for forming an image that is indicated by image data transmitted from an external unit (step S11). Next, the image forming system 1 determines if the fixing of a toner image expressing the required image has been completed (step S12). When it is determined that the fixing of the toner image is not yet completed (NO), the image forming system 1 performs the operation of step S11. When it is determined that the fixing of the toner image has been completed (YES) in step S12, the image forming system 1 reduces the transport speed (step S13). Steps S12 and S13 are the operations performed by the control section 101 and the transport section 103.

Next, the image forming system 1 determines if the surface temperature of the rotatable members 40 has dropped to or below the first temperature (step S14). When it is determined that the surface temperature has not yet dropped to or below the first temperature (NO), the image forming system 1 returns to step S13 and performs the operation. Note that the image forming system 1 does not necessarily have to reduce the transport speed every time when it returns to step S13, and, in the case of reducing the transport speed by one level every 10 seconds as described above, the transport speed is reduced when 10 seconds have elapsed since the previous reduction in the transport speed. When it is determined that the surface temperature has dropped to or below the first temperature in step S14 (YES), the image forming system 1 stops the rotation of the rotatable members 40 and the transportation of the medium (step S15). Steps S14 and S15 are the operations performed by the control section 101, the fixing section 102, and the transport section 103.

[1-4] Other Examples

Although the control section 101 reduces the transport speed in step S13 in the example above, the control performed by the control section 101 is not limited thereto. For example, the control section 101 repeatedly reverses the transport direction of the medium P1 by controlling the fixing section 102 and the transport section 103. More specifically, the control section 101 reverses the transport direction every time when a predetermined time (e.g., 10 seconds) has elapsed. Alternatively, the control section 101 may reverse the transport direction every time when the medium P1 has been transported by a predetermined length.

Figure 6:
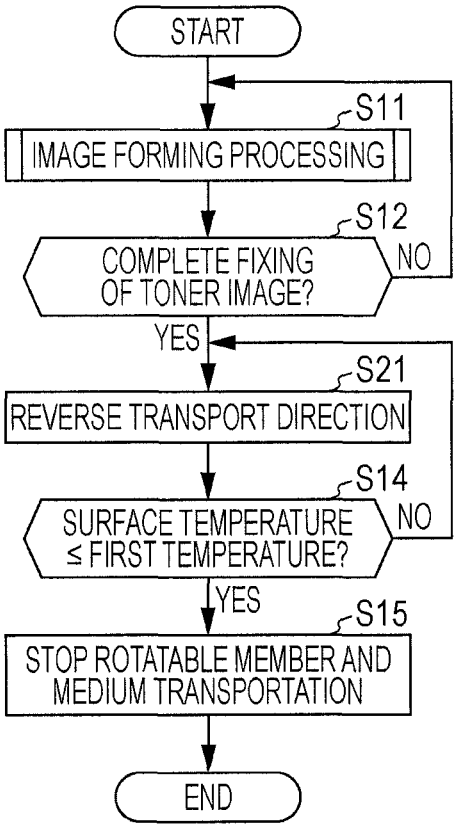
FIG. 6 is a flowchart showing another exemplary operation of the image forming system in the adhesion prevention processing.

FIG. 6 is a flowchart showing another exemplary operation of the image forming system 1 in the adhesion prevention processing. In this example, the image forming system 1 reverses the transport direction of the medium P1 (step S21) when it is determined that the fixing of the toner image has been completed (YES) in step S12.

The control section 101 may perform both reduction in transport speed and repeated reversing of the transport direction. In this case, the control section 101 may perform the reduction in transport speed and the reversing of transport direction either at the same or different intervals. Furthermore, the control section 101 may vary the intervals or may terminate the reduction in transport speed and the reversing of transport direction when a predetermined number of times has been reached.

[1-5] Advantages of First Exemplary Embodiment

In this exemplary embodiment, when the surface temperature of the contact portions of the rotatable members 40 is lower than or equal to the first temperature, which is below the softening temperature, the rotation of the rotatable members 40 is stopped. The surfaces of the medium P1 that are in contact with the surfaces of the rotatable members 40 at the first temperature will not soften. Hence, according to this exemplary embodiment, the medium does not soften after the transportation of the medium has been stopped. Furthermore, in this exemplary embodiment, the fixing section 102 does not have a separating device. Because the space for providing a device that separates the rotatable members 40 and the medium P1 is unnecessary, the apparatus is smaller than that with the separating device.

When a portion of the softened medium P1 adheres to the rotatable members 40, the portion may be transferred from the rotatable members 40 to another part of the medium P1. That is, a portion of the softened medium P1 adheres to the medium P1 itself via the rotatable members 40. In this exemplary embodiment, the control section 101 performs the above-described suppressing operation (operation for preventing a portion of the medium P1 from softening, peeling off, and adhering to the rotatable members 40) by controlling the fixing section 102. Accordingly, adhesion of a portion of the softened medium P1 to the medium P1 via the rotatable members 40 is less likely to occur than in a case where the suppressing operation is not performed. In this exemplary embodiment, the adhesion of a portion of the medium softened by the heat of the rotatable members heated in the fixing operation to the medium itself is less likely to occur than in a case where the suppressing operation is not performed, i.e., a case where the control of the fixing section as described above is not performed.

Furthermore, in this exemplary embodiment, after it is determined that the fixing of the toner image on the medium P1 has been completed, an operation such as reducing the transport speed or reversing the transport direction is performed. By doing so, the amount of the medium P1 transported until the rotation of the rotatable members 40 is stopped, i.e., until the transportation of the medium P1 is stopped, is reduced compared with a case where the transportation of the medium P1 is continued without changing the transport speed or transport direction. The medium P1 that has been transported from the completion of the fixing to the stopping of the rotation of the rotatable members 40 is not used for forming an image. In other words, according to this exemplary embodiment, the amount of medium that is not used for forming an image is smaller than that in a case where the above-described control of the transport section and a pressure section is not performed.

[2] Second Exemplary Embodiment

A second exemplary embodiment of the present invention will be described below, focusing on the difference from the first exemplary embodiment. In the first exemplary embodiment, the control performed when stopping the rotation of the rotatable members 40 has been described. In the second exemplary embodiment, the control performed when starting the rotation of the rotatable members 40 will be described.

[2-1] Functional Configuration

In this exemplary embodiment, the control section 101 starts the rotation of the rotatable members 40 when the temperature (i.e., surface temperature) of the contact portions (portions in contact with the medium P1) of the rotatable members 40 is higher than or equal to a second temperature. If a portion of the softened medium P1 adheres to the contact portions, the portion may peel off from the medium P1 and stay on the contact portions when the rotatable members 40 are rotated. If the rotation is started when the temperature of the contact portions is higher than or equal to the second temperature, the portion softens again due to the heat conducting from the contact portions and is easily detached from the contact portions compared with a case where the temperature of the contact portions is lower than the second temperature. The operation of starting the rotation by the control section 101 in this way is the above-described suppressing operation (operation for preventing a portion of the medium P1 from softening, peeling off, and adhering to the rotatable members 40). More specifically, the control section 101 starts the rotation of the rotatable members 40 by using a temperature that is higher than or equal to the softening temperature (temperature at which the softenable layers P10 of the medium P1 soften) as the second temperature.

When, for example, image data is transmitted from an external unit, the control section 101 stores W° C. (for example, 140° C.), which is higher than or equal to the above-described softening temperature X° C. (for example, 100° C.) (W>X), as the second temperature. Note that it is desirable that W° C. be less than the surface temperature of the rotatable members 40 when fixing a toner image, i.e., fixing temperature Y° C. (for example, 180° C.). For example, when image data is transmitted from an external unit, the control section 101 determines if the temperature indicated by the supplied temperature data is higher than or equal to the second temperature each time when the temperature data is supplied from temperature sensors 60. When it is determined that the temperature is higher than or equal to the second temperature, the control section 101 starts the rotation of the rotatable members 40 by controlling the fixing section 102.

Furthermore, after the temperature of the contact portions of the rotatable members 40 has reached or exceeded the second temperature, the control section 101 gradually increases the transport speed of the medium P1 by controlling the transport section 103. For example, the control section 101 preliminarily determines the medium transport speed at the time when image forming processing is started (this transport speed is referred to as "processing start speed") and, when the transport speed may be varied across 10 levels to the processing start speed, increases the transport speed by one level at predetermined time intervals (e.g., every second).

[2-2] Operation

Figure 7:
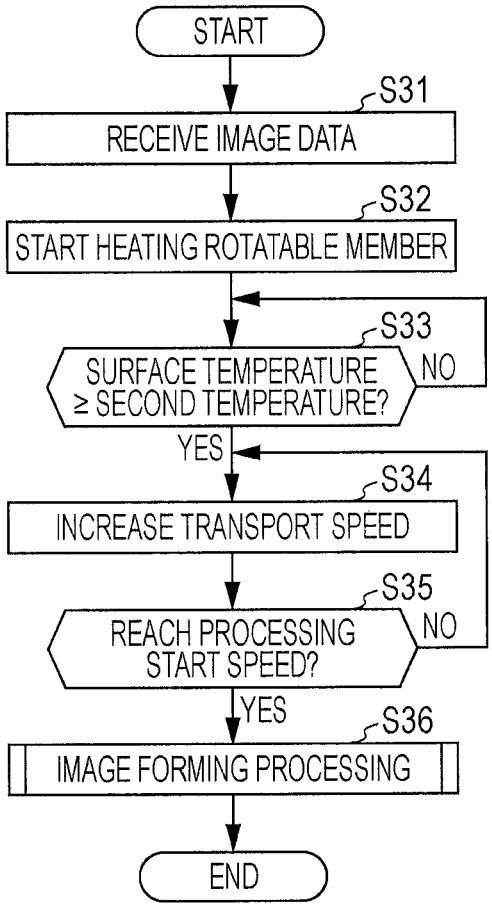
FIG. 7 is a flowchart showing another exemplary operation in adhesion prevention processing according to a second exemplary embodiment.

FIG. 7 is a flowchart showing another exemplary operation of the image forming system 1 according to the second exemplary embodiment in the adhesion prevention processing. First, the image forming system 1 receives image data transmitted from an external unit (step S31). Next, the image forming system 1 starts the heating of the rotatable members 40 (step S32). Then, the image forming system 1 determines if the surface temperature of the contact portions of the rotatable members 40 has reached or exceeded the second temperature (step S33). When it is determined that the surface temperature has not yet reached or exceeded the second temperature (NO), the image forming system 1 repeatedly performs the operation of step S33. When it is determined that the surface temperature has reached or exceeded the second temperature (YES), the image forming system 1 increases the transport speed (step S34).

Then, the image forming system 1 determines if the transport speed has reached the processing start speed (step S35). When it is determined that the transport speed has not yet reached the processing start speed (NO), the image forming system 1 returns to step S34 and performs the operation. When it is determined that the transport speed has reached the processing start speed (YES), the image forming system 1 performs the image forming processing (step S36).

[2-3] Other Examples

In the second exemplary embodiment too, the control section 101 may repeatedly reverses the medium transport direction. More specifically, the control section 101 reverses the transport direction at predetermined time intervals (e.g., every one second), after the temperature of the contact portions of the rotatable members 40 has reached or exceeded the second temperature. Furthermore, as described above, the control section 101 may gradually increase the transport speed while repeatedly reversing the transport direction.

[2-4] Advantage of Second Exemplary Embodiment

In the second exemplary embodiment, when the temperature of the contact portions of the rotatable members 40 is higher than or equal to the second temperature, which is higher than or equal to the softening temperature, the rotation of the rotatable members 40 is started. With this configuration, when a portion (more specifically, the softenable layers P10) of the softened medium P1 adheres to the rotatable members 40, the adherent softens again before the rotation of the rotatable members 40 is started. At this time, the softened adherent may adhere to the medium P1, not to the rotatable members 40, as a result of the start of the rotation of the rotatable members 40. If the second temperature is lower than the softening temperature, the adherent does not soften before the rotation of the rotatable members 40 is started and, hence, remains on the rotatable members 40 even after the rotation is started. According to this exemplary embodiment, a portion of the medium adhered to the rotatable member (i.e., the above-mentioned adherent) is easily detached from the rotatable member compared with a case where a temperature lower than the softening temperature is used as the second temperature.

The adherent softened as described above is more easily detached if it is brought into contact with the medium in a more softened state. In this exemplary embodiment, the transport speed is gradually increased until the transport speed reaches the processing start speed (medium transport speed at the time when the image forming processing is started). Hence, the duration of time for which the softened adherent is in contact with the medium is increased, enabling a large amount of adherent to be detached compared with a case where the transport speed is more quickly increased.

The more the adherent is brought into contact with the medium, the more the adherent is detached. However, this increases the amount of medium on which an image is not formed. In this exemplary embodiment, the transport direction is reversed until the transport speed reaches the processing start speed. By doing so, the amount of medium on which an image is not formed decreases compared with a case where the transport direction is not changed.

[3] Third Exemplary Embodiment

A third exemplary embodiment of the present invention will be described below, focusing on the difference from the first and second exemplary embodiments. In the first and second exemplary embodiments, the fixing section does not have a separating device (a device that separates the rotatable members 40 and the medium P1). However, in the third exemplary embodiment, the fixing section includes separating devices and members (hereinbelow, "insertion members") that may be inserted into the spaces between the rotatable members 40 and the medium P1 created by separating them.

[3-1] Hardware Configuration

Figure 8:
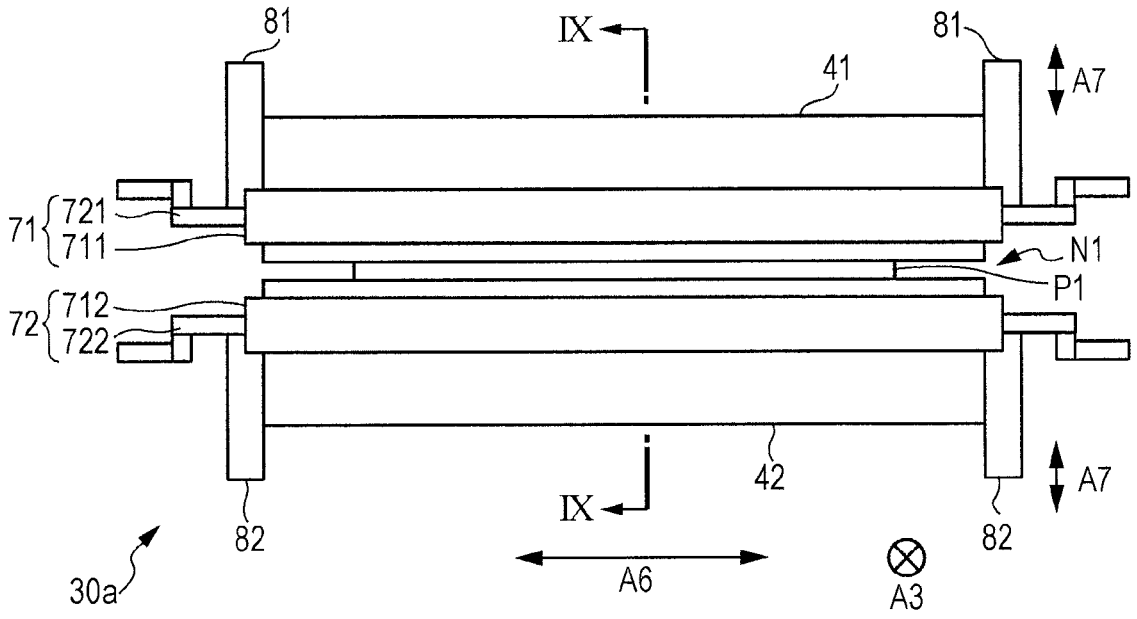
FIG. 8 is a diagram showing an example of a fixing unit according to a third exemplary embodiment.

FIG. 8 is a diagram showing an example of the fixing unit according to the third exemplary embodiment. In this example, a fixing unit 30*a* oriented in the transport direction A3 for the medium P1 is shown. In FIG. 8, a direction along rotation shafts of the rotatable members 40 is referred to as a width direction A6 (direction across the width of the medium P1), and a direction along the perpendicular of the medium P1 in the nip area N1 is referred to as a top-bottom direction A7. The fixing unit 30*a* includes insertion units 71 and 72 (hereinbelow, collectively referred to as "insertion units 70" where distinction is not needed) and separating units 81 and 82 (hereinbelow, collectively referred to as "separating units 80" where distinction is not needed).

The insertion units 71 and 72 have insertion members 711 and 712 (hereinbelow, collectively referred to as "insertion members 710" where distinction is not needed) and rotation portions 721 and 722 (hereinbelow, collectively referred to as "rotation portions 720" where distinction is not needed). The insertion members 710 are larger than the rotatable members 40 in the width direction and are made of, for example, poly phenylene sulfide resin (PPS) containing glass. Alternatively, the insertion members 710 may be made of a material such as liquid crystal polymer (LCP), sheet metal, or a compacted glass wool and polyimide. It is desirable that the insertion members 710 be made of a material having lower thermal conductivity, higher thermal resistance, or larger specific heat. The thermal conductivity is measured by, for example, a steady heat flow method or a transient heat flow method. The thermal resistance is a value obtained by dividing the thickness of the member by the thermal conductivity. The thickness of the member in this case is a thickness in the direction from the heaters 50 toward the medium P1. In this exemplary embodiment, the insertion members 710 have lower thermal conductivity, higher thermal resistance, or larger specific heat than the rotatable members 40.

The insertion members 710 are provided on the upstream side of the rotatable members 40 in the transport direction A3, and the both ends thereof in the width direction A6 are connected to the rotation portions 720. The rotation portions 720 are supported so as to be rotatable about the rotation shafts of the rotatable members 40. The rotation portions 720 are controlled by the control unit 5 so as to be rotated or stopped. The separating units 80 are provided at both ends of the rotatable members 40 in the width direction A6 and move the rotatable members 40 in the top-bottom direction A7. The separating units 80 are an example of a separating device and separate the rotatable members 40 and the medium P1 by moving the rotatable members 40 in a direction away from the medium P1.

Figure 9A:
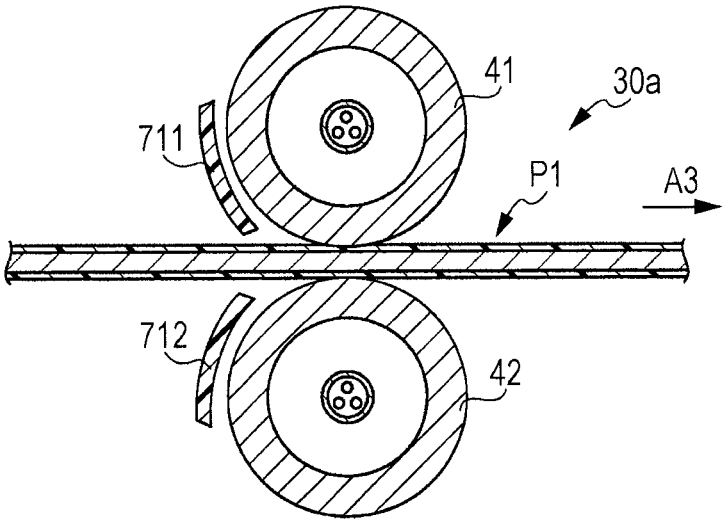
FIGS. 9A and 9B are diagrams showing a situation where insertion members are inserted into spaces between rotatable members and a medium.
Figure 9B:
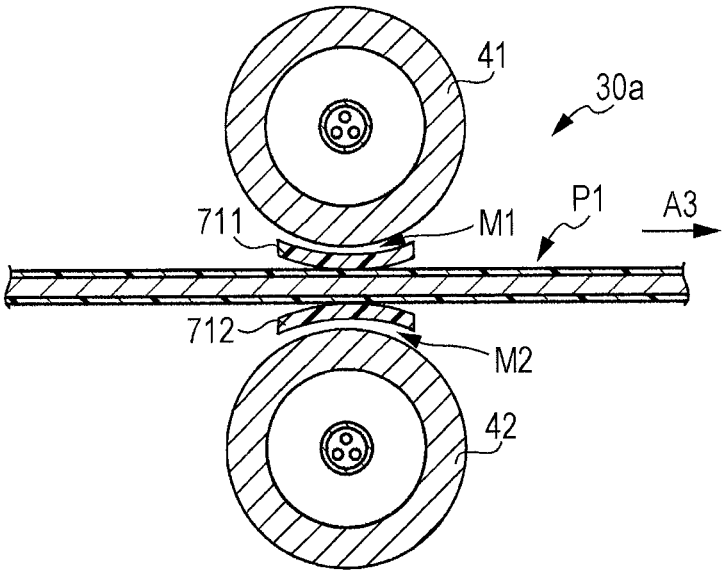

FIGS. 9A and 9B are diagrams showing a situation where the insertion members 710 are inserted into spaces between the rotatable members 40 and the medium P1. FIGS. 9A and 9B show the end faces of the fixing unit 30*a* and medium P1, as viewed in a direction indicated by allows IX-IX in FIG. 8. The insertion members 710 are plate members that are curved along the surfaces of the rotatable members 40. FIG. 9A shows a state in which the insertion members 710 are disposed with the curved surfaces facing the surfaces of the rotatable members 40. FIG. 9B shows a state in which the insertion member 711 is inserted into a space M1 and the insertion member 712 is inserted into a space M2, which spaces are produced by separating the rotatable members 40 and the medium P1 using the separating units 80 shown in FIG. 8. In this manner, the insertion members 710 are inserted into the spaces between the rotatable members 40 and the medium P1. Furthermore, by the respective driving units performing operations opposite from those described above, the insertion members 710 return to the state shown in FIG. 9A from the state shown in FIG. 9B. In this case, the insertion members 710 are retracted from the spaces between the rotatable members 40 and the medium P1. The fixing unit 30*a* has the insertion members 710 that may be inserted into or retracted from the spaces between the rotatable members 40 and the medium P1, produced by the separating units 80.

[3-2] Functional Configuration

Figure 10:
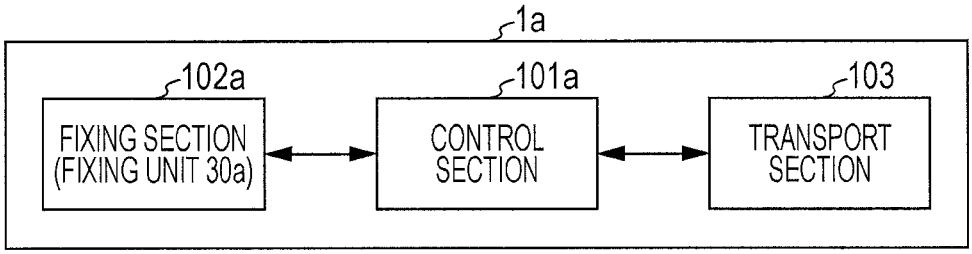
FIG. 10 is a diagram showing an exemplary functional configuration of the image forming system.

FIG. 10 is a diagram showing an exemplary functional configuration of the image forming system according to this exemplary embodiment. This example shows an image forming system 1*a* that includes a control section 101*a*, a fixing section 102*a*, and the transport section 103. The fixing section 102*a* is a function achieved by the fixing unit 30*a* shown in FIGS. 9A and 9B and includes the separating units 80, which are the separating device, and the insertion members 710. The control section 101*a*, through the control of the fixing section 102*a*, causes the insertion members 710 to be inserted into the spaces when the rotation of the rotatable members 40 is completed and causes the insertion members 710 to be retracted therefrom when the rotation of the rotatable members 40 is started. By inserting the insertion members 710, the rotatable members 40 will touch only the insertion members 710, not the medium P1, even if the medium P1 becomes wavy and moves in the top-bottom direction A7. Accordingly, even if a portion of the medium P1 softens, the portion does not adhere to the rotatable members 40 but it adheres to the insertion members 710. The operation of inserting/retracting the insertion members 710 into/from the spaces by the control section 101*a* is the above-described suppressing operation (operation for preventing a portion of the medium P1 from softening, peeling off, and adhering to the rotatable members 40). The image forming system 1*a* performs the adhesion prevention processing in this exemplary embodiment, using the above-described configuration.

[3-3] Operation

Figure 11:
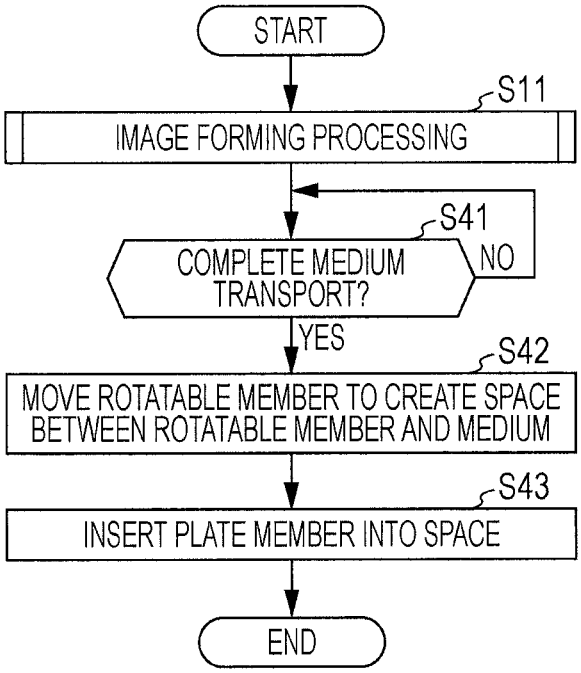
FIG. 11 is a flowchart showing an exemplary operation of the image forming system in the adhesion prevention processing.

FIG. 11 is a flowchart showing an exemplary operation of the image forming system 1 according to this exemplary embodiment in the adhesion prevention processing. FIG. 11 shows the operation performed when the rotation of the rotatable members 40 is stopped. First, the image forming system 1*a* performs the operation of step S11 (image forming processing) shown in FIG. 5. Next, the image forming system 1*a* determines if the transportation of the medium has been completed (step S41). When it is determined that the transportation of the medium has not yet been completed (NO), the image forming system 1*a* repeatedly performs the operation of step S41. When it is determined that the transportation of the medium has been completed (YES), the image forming system 1*a* moves the rotatable members 40 to create spaces, such as the spaces M1 and M2 as shown in FIG. 9B, between the rotatable members 40 and the medium P1 (step S42). Next, the image forming system 1*a* inserts the insertion members 710 into the spaces (step S43). As a result, the insertion members 710 and the rotatable members 40 are in the state shown in FIG. 9B.

Figure 12:
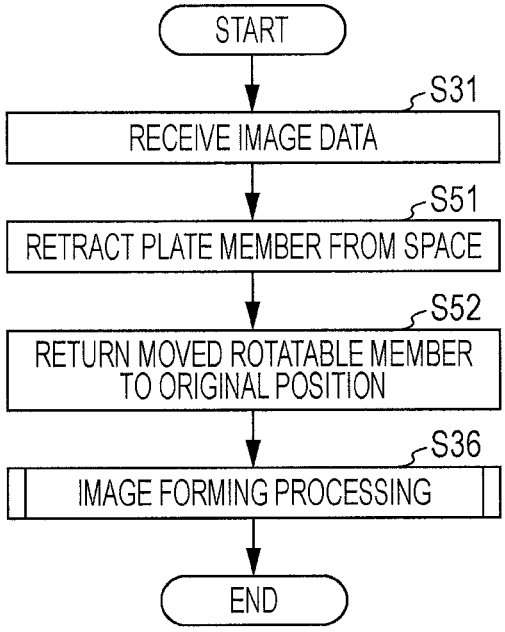
FIG. 12 is a flowchart showing another exemplary operation of the image forming system in the adhesion prevention processing.

FIG. 12 is a flowchart showing another exemplary operation of the image forming system 1 according to this exemplary embodiment in the adhesion prevention processing. FIG. 12 shows the operation to be performed when the rotation of the rotatable members 40 is started after the operation of FIG. 11 is performed. That is, when the operation shown in FIG. 12 is to be started, the insertion members 710 are inserted into the spaces M1 and M2 between the rotatable members 40 and the medium P1. In this state, first, the image forming system 1*a* performs the operation of step S31 (receive image data) shown in FIG. 7. Next, the image forming system 1*a* retracts the insertion members 710 from the spaces M1 and M2 (step S51). Then, the image forming system 1*a* returns the moved rotatable members 40 to the original position (step S52) and performs the operation of step S36 (image forming processing).

[3-4] Advantage of Third Exemplary Embodiment

As has been described above, in this exemplary embodiment, the medium P1 stops without touching the rotatable members 40. Even if the medium P1 softens at this time, the softened medium P1 adheres to the insertion members 710. Hence, in this exemplary embodiment, the softened medium does not adhere to the rotatable members 40. Furthermore, even if a force is applied to the insertion members 710, bringing the insertion members 710 into contact with the rotatable members 40, because the heat of the rotatable members 40 is used to heat the insertion members 710, the amount of heat conducting to the medium P1 is smaller than in a case where the rotatable members 40 are in contact with the medium P1. Moreover, in this exemplary embodiment, as described above, because the insertion members 710 have lower thermal conductivity, higher thermal resistance, or larger specific heat than the rotatable members 40, the heat of the rotatable members 40 is less likely to conduct to the medium P1, and thus, the medium P1 is less likely to soften than in a case where such insertion members 710 are not used.

[4] Modifications

The above-described exemplary embodiments are merely examples of the present invention and may be modified as described below. Furthermore, the above-described exemplary embodiments and the modifications shown below may be combined for implementation if necessary.

[4-1] Change First and Second Temperature

In the first and second exemplary embodiments, the control section 101 may change the first and second temperatures.

Figure 13:
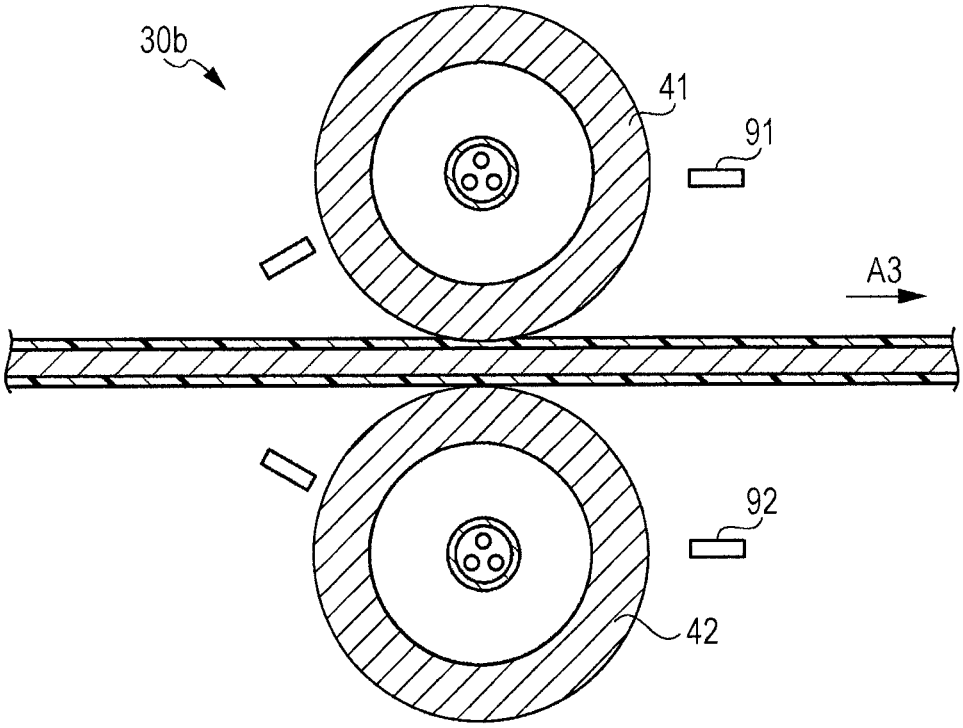
FIG. 13 is a diagram showing an example of a fixing unit according to a modification.

FIG. 13 is a diagram showing an example of a fixing unit according to this modification. In this example, a fixing unit 30*b* having adhesion detecting sensors 91 and 92 (hereinbelow, collectively referred to as "adhesion detecting sensors 90" where distinction is not needed) in addition to the components shown in FIG. 3 is shown. The adhesion detecting sensors 90 are sensors for detecting if a portion of the softened medium P1 adheres to the surfaces of the rotatable members 40. The adhesion detecting sensors 90 are, for example, image sensors and, in such as case, detect the intensity of color in areas (hereinbelow, "detection areas") from one end to the other end, in the width direction, of the surfaces of the rotatable members 40. The adhesion detecting sensors 90 supply the control unit 5 with data indicating that the intensity is constant when a portion of the softened medium P1 does not adhere to the detection area, and data indicating that the intensity is varied when a portion of the softened medium P1 adheres to the detection area.

In this exemplary embodiment, the control section 101 changes the first and second temperatures depending on the degree to which the medium P1 adheres to the rotatable members 40 (hereinbelow, "degree of adhesion"). The control section 101 determines the degree of adhesion by the proportion of the area of a portion having varied intensity in the detection area (hereinbelow, "adhesion rate"). The control section 101 stores correlation data showing the correlation between the adhesion rate and the first and second temperatures.

Figure 14A:
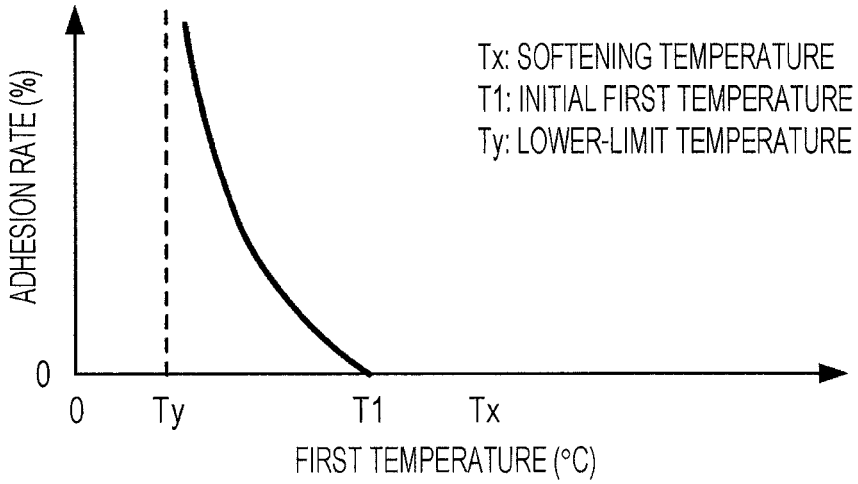
FIGS. 14A and 14B are diagrams showing an example of correlation data.
Figure 14B:
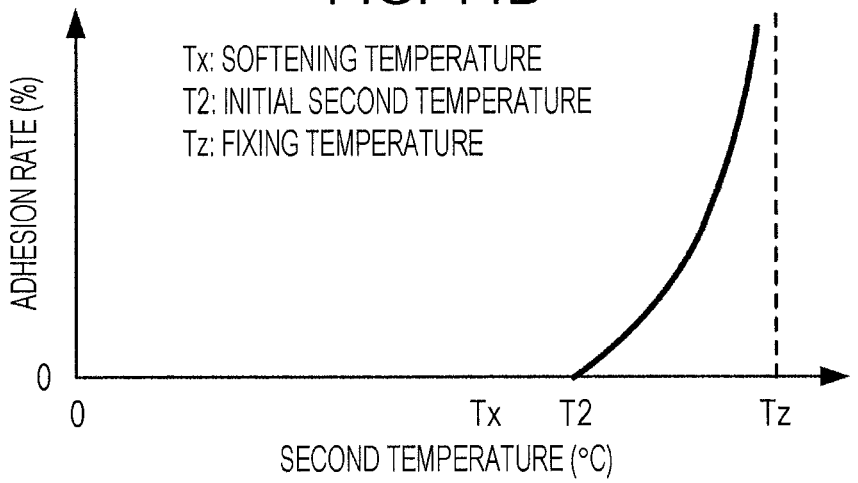

FIGS. 14A and 14B show examples of the correlation data. FIGS. 14A and 14B show graphs in which the vertical axis indicates the adhesion rate (in percent (%)) and the horizontal axis indicates the first and second temperatures (in degrees (° C.)). In the graphs, Tx denotes the softening temperature of the medium P1, T1 denotes the initial first temperature, T2 denotes the initial second temperature, Ty denotes the lower-limit temperature, and Tz denotes the fixing temperature. The initial first temperature and the initial second temperature are the first temperature and the second temperature when the adhesion rate is 0%. At the initial stage before an image is formed on the medium P1, the first and second temperatures are set to these values. The lower-limit temperature is the lowest first temperature and is set to a temperature higher than or equal to the temperature reached when the heated surfaces of the rotatable members 40 cool. Otherwise (if lower than this), the surface temperature of the rotatable members 40 will not reach the first temperature, and the rotation will not be stopped.

As shown in FIG. 14A, at an adhesion rate of 0%, the first temperature is the initial first temperature T1, which is lower than the softening temperature Tx, and, as the adhesion rate increases, the first temperature decreases toward the lower-limit temperature Ty. As shown in FIG. 14B, at an adhesion rate of 0%, the second temperature is the initial second temperature T2, which is higher than or equal to the softening temperature Tx, and, as the adhesion rate increases, the second temperature increases toward the fixing temperature Tz. For example, the control section 101 detects the adhesion rate and changes the first temperature to a value corresponding to the detected adhesion rate before starting the rotation of the rotatable members 40 that has been stopped and before a portion thereof that has been in contact with the medium P1 will come into contact with the medium P1 again. Furthermore, for example, the control section 101 detects the adhesion rate after starting the rotation of the rotatable members 40 and immediately before a formed toner image arrives at the nip area N1, and changes the second temperature to a value corresponding to the detected adhesion rate.

In the examples of FIGS. 14A and 14B, the first and second temperatures are each shown as a quadratic curve that converges on the lower-limit temperature or the fixing temperature. However, it is also possible that the first and second temperatures are changed linearly to the lower-limit temperature and the fixing temperature, respectively, from where the temperatures are not changed. Furthermore, the degree of adhesion does not necessarily have to be expressed by adhesion rates, but by levels determined by, for example, ranges of the adhesion rate (e.g., an adhesion rate of less than 5% is level 1, an adhesion rate of 5% or more to less than 10% is level 2, and an adhesion rate of 10% or more is level 3). That is, it is only needed that the degree of adhesion indicates the degree to which the medium P1 adheres to the rotatable members 40.

In the first exemplary embodiment, even when the surface temperature when the rotatable members 40 are stopped is lower than or equal to the first temperature (i.e., lower than the softening temperature), the surfaces of the medium P1 may soften and a portion thereof may adhere to the rotatable members 40 due to the temperature of the medium P1 itself and due to the quality of the coating material (i.e., softenable layers P10). Furthermore, temperature higher than or equal to the softening temperature may be used as the first temperature for such reasons that the softening temperature of some media is unknown and that the type of the media is frequently changed. In this modification, in such a situation, by changing the first temperature depending on the detected adhesion rate as described above, the surface temperature will be a lower first temperature when the rotatable members 40 are stopped next time. With this configuration, the surfaces of the medium P1 are less likely to soften and, hence, a portion thereof is less likely to adhere to the rotatable members 40 than in a case where the first temperature is not changed.

Furthermore, in the second exemplary embodiment, even if the surface temperature when the rotation of the rotatable members 40 is started is higher than or equal to the second temperature (i.e., higher than or equal to the softening temperature), the adherent (a portion of the medium P1 adhered to the rotatable members 40) may not sufficiently soften and, thus, may not be detached from the rotatable members 40. In this modification, in such a case, the second temperature is changed depending on the detected adhesion rate, as described above. With this configuration, the adherent is more likely to soften and is more easily detached from the rotatable member than in a case where the second temperature is not changed.

[4-2] Start Image Forming Depending on Adhesion Rate

The control section 101 may determine the timing of starting the toner image depending on the above-described degree of adhesion.

Figure 15:
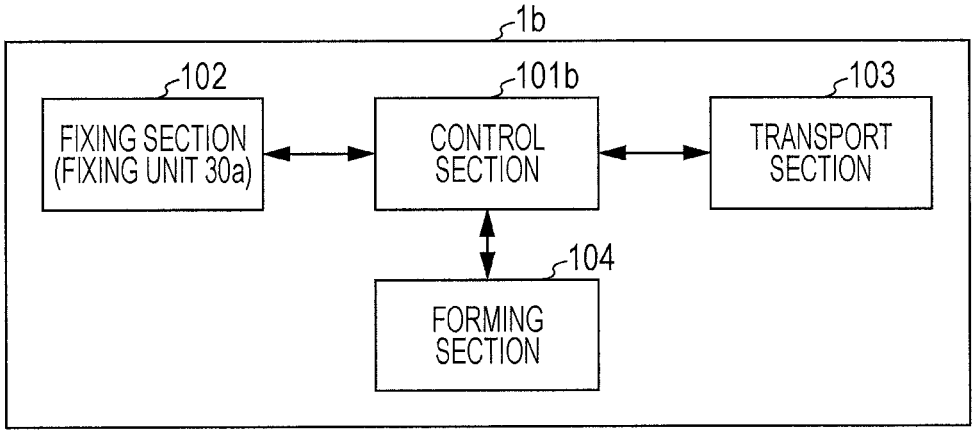
FIG. 15 is a diagram showing an exemplary functional configuration of the image forming system according to the modification.

FIG. 15 is a diagram showing an exemplary functional configuration of the image forming system according to this modification. In this example, an image forming system 1*b* including a control section 101*b*, the fixing section 102, the transport section 103, and a forming section 104 is shown. The forming section 104 is an example of a device that forms a toner image on a medium transported by the transport section 103. The control section 101*b* controls the forming section 104 to start formation of a toner image on a medium when the degree of adhesion satisfies a predetermined condition.

An example of the predetermined condition is a condition that is satisfied when the adhesion rate, if it is used as the degree of adhesion, is below the threshold (for example, 3%). In this case, when the detected adhesion rate is higher than or equal to the threshold, the control section 101 heats the rotatable members 40 and transports the medium P1 without starting the formation of a toner image to detach the adherent, and, when the detected adhesion rate is lower than the threshold, the control section 101 starts the formation of a toner image. According to this modification, when an allowable degree of adhesion is determined (for example, when the adhesion of an adherent to a portion of a medium on which a toner image is to be formed is allowed if the adhesion rate is less than 3%), the degree of adhesion is used as the threshold. By doing so, the formation of a toner image is started early compared with a case where the above-described control of the forming section 104 is not performed.

[4-3] Start Image Formation According to Time Elapsed

The control section 101 may determine the timing of starting the formation of a toner image according to criteria other than the degree of adhesion. More specifically, the control section 101 may determine the timing according to the time elapsed since the start of the rotation of the rotatable members 40 (for example, the formation of a toner image is started when 10 seconds has elapsed). Alternatively, the control section 101 may determine the timing according to the length of the medium transported (for example, the formation of a toner image is started when the medium has been transported for three meters).

[4-4] First Temperature Higher than or Equal to Softening Temperature

Although a case where the first temperature is lower than the softening temperature has been described in the first exemplary embodiment, the first temperature may be higher than or equal to the softening temperature. Although the first temperature is desirably lower than the softening temperature, the first temperature could be higher than or equal to the softening temperature for such reasons that, in the case of the medium P1, the softening temperature indicated as product information is different from the actual softening temperature due to the quality of the coating material (i.e., softenable layers P10) or the like, that the softening temperature of some media is unknown, and that there is little time to change the first temperature due to frequent changes in type of the medium. Even in such a case, by determining the first temperature, softening of the medium after stopping the transportation of the medium is less likely to occur than in a case where the rotation of the rotatable members 40 is stopped at a temperature higher than the first temperature.

[4-5] Second Temperature Lower than Softening Temperature

Although a case where the second temperature is higher than or equal to the softening temperature has been described in the second exemplary embodiment, the second temperature may be lower than the softening temperature. Although the second temperature is desirably higher than or equal to the softening temperature, the second temperature could become lower than the softening temperature for the same reasons as the first temperature. Even in such a case, by determining the second temperature, the surface temperature of the rotatable members 40 increases quickly and the adherent becomes an easily separable state compared with a case where the rotation of the rotatable members 40 is started at a temperature lower than the second temperature. As a result, if the timing of starting the formation of a toner image is the same, more adherent are separated than the above-described case. In this modification too, a temperature lower than the fixing temperature is used as the second temperature. The reason for this is that, because the rotatable members 40 will not be heated above the fixing temperature, a medium that softens only at a temperature higher than that will not adhere to the rotatable members 40.

[4-6] Medium

Although cases where the medium P1 having the coating material on each surface (i.e., the medium P1 having the softenable layers P10 on both of the front and rear surfaces thereof) is used have been described in the above-described exemplary embodiments, a medium having the coating material on either one of the front and rear surfaces may be used. In this case too, the surface with the coating material may soften and adhere to the rotatable members 40. Furthermore, the medium is not limited to those having a softenable layer as a coating layer. For example, the medium may be a sheet member that is made of, for example, polypropylene that softens at a temperature lower than or equal to the fixing temperature. This medium also has a softenable layer on the surface thereof, so, the softenable layer may soften and adhere to the rotatable members 40. When the medium having a softenable layer is used for forming an image, it is desirable that the control section 101 perform control using the first and second temperatures determined according to the softening temperature of the softenable layer, as in the first and second exemplary embodiments.

[4-7] Transport Passed Medium in Opposite Direction

In the first exemplary embodiment, the control section 101 may transport the medium that has been transported since the completion of the fixing until the stopping of the rotation of the rotatable members 40 in the direction opposite to the transport direction, at the next start of the rotation of the rotatable members 40. This portion of the medium does not have a toner image fixed thereto. In other words, an image is not formed thereon. Hereinbelow, such a medium will be referred to as an "unformed medium". If a next image is to be formed without taking any measure, the unformed medium is wasted. However, in this modification, because the unformed medium is transported in the opposite direction and then an image is formed, the medium is not wasted. Note that it is desirable that the transportation of the unformed medium in the opposite direction by the control section 101 be performed when the medium does not soften or adheres to the rotatable members 40 owing to the control explained in the first exemplary embodiment.

[4-8] Control Only Fixing Device

Although the control section 101 controls the fixing section 102 and the transport section 103 in the above-described exemplary embodiments, the control section 101 may control only the fixing section 102. In such a configuration, the operation of reducing the transport speed and the operation of reversing the transport direction, which have been described in the first and second exemplary embodiments, are not performed. However, even in such a configuration, a portion of the medium softened by the heat of the rotatable members heated in the fixing still becomes less likely to adhere to the medium than in a case where the control of the fixing section is not performed.

[4-9] Fixing Unit

The fixing unit is not limited to those described in the above-described exemplary embodiments. For example, although the rotatable members provided in the fixing unit were rollers according to the above-described exemplary embodiments, they may alternatively be endless belts. That is, the rotatable members may be anything as long as they are capable of applying heat and pressure to the medium while being heated. Furthermore, the heaters of the fixing unit employ halogen lamps to heat the rotatable members 40 in the above description, induction heating (IH) heaters may also be used. That is, the heaters may be anything as long as they are capable of heating the rotatable members.

[4-10] Insertion Member

The insertion members are not limited to those described in the third exemplary embodiment.

Figure 16A:
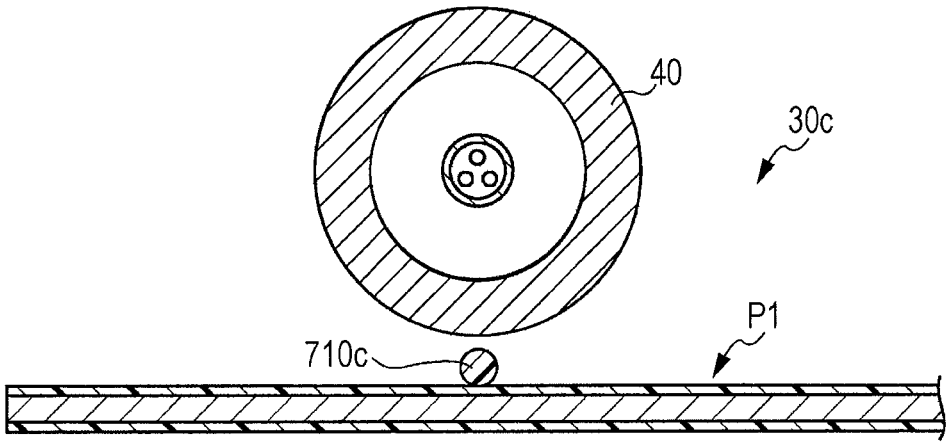
FIGS. 16A and 16B are diagrams showing an example of an insertion member according to the modification.
Figure 16B:
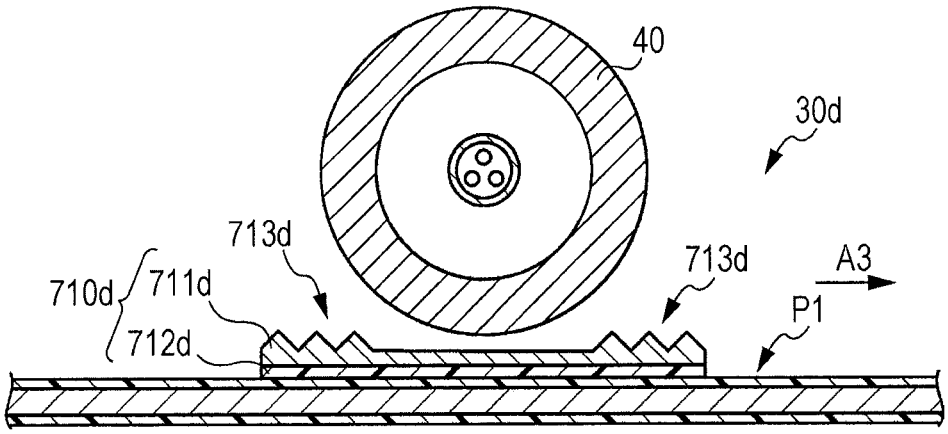

FIGS. 16A and 16B are diagrams showing an example of an insertion member according to the modification. FIGS. 16A and 16B show the end faces of the fixing unit and medium P1, as viewed in the direction indicated by the allows IX-IX in FIG. 8, similarly to FIGS. 9A and 9B, and show only one of the rotatable members 40. FIG. 16A shows a fixing unit 30*c* that includes an insertion member 710*c* having a round end face. Like this one, the insertion member do not necessarily has to be plate-shaped as shown in FIGS. 8 and 9, as long as it separates the rotatable member 40 and the medium P1.

Furthermore, FIG. 16B shows a fixing unit 30*d* that includes an insertion member 710*d* having a first member 711*d* and a second member 712*d*, which are both plate-shaped. The first member 711*d* is made of, for example, metal, and the second member 712*d* is made of, for example, resin. Thus, the first member 711*d* has higher thermal conductivity than the second member 712*d*. Furthermore, several protrusions ("protruding portions 713*d*") are formed on the surface of the first member 711*d*, at both ends in the transport direction A3. With this configuration, a portion of the heat conducting to the insertion member 710*d* due to the heat radiation from the rotatable member 40 or a portion of the heat conducting to the insertion member 710*d* when the protruding portions 713*d* are brought into contact with the rotatable member 40 upon application of a force diffuses in the first member 711*d* and is radiated to the air from the protruding portions 713*d*. Thus, the amount of heat conducting from the rotatable member 40 to the medium P1 decreases, making the medium P1 less likely to soften than in a case where the insertion member does not have the first member 711*d*. Note that the protruding portions of the first member are optional. The insertion member may have only the first member. Even in such a configuration, the heat conducting from the rotatable member 40 diffuses in the first member and conducts to the medium P1 in a diffused manner, without being focused on a certain portion thereof. Accordingly, the medium P1 is less likely to soften than in a case where the insertion member does not have the first member.

[4-11] Image Forming Apparatus

Although the image forming apparatus according to the above-described exemplary embodiments forms color images using the photoconductor drums and developing devices arranged along the intermediate transfer belt, the image forming apparatus may be of any configuration as long as it fixes a toner image onto a medium. For example, the image forming apparatus may have a rotary developing device having developing devices provided along the circumferential direction of a rotary member, or may be of a direct-transfer type in which a toner image is directly transferred from a photoconductor drum to a recording medium.

[4-12] Category of Invention

The present invention may be understood as, not only an image forming apparatus and an image forming system having the image forming apparatus, but also a fixing device having a fixing section and a control section.

Figure 17A:
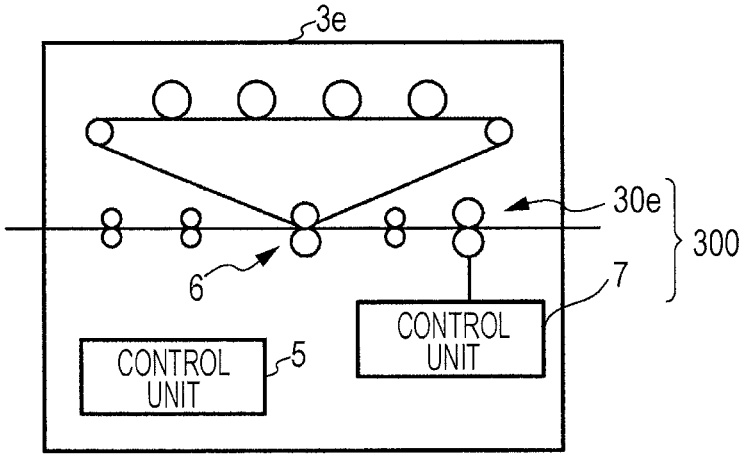
FIGS. 17A and 17B are diagrams showing exemplary hardware configuration and functional configuration of the fixing device.
Figure 17B:
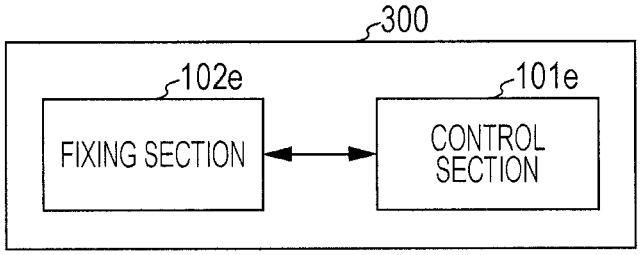

FIGS. 17A and 17B are diagrams showing exemplary hardware configuration and functional configuration of the fixing device. FIG. 17A shows an image forming apparatus 3*e* including a fixing device 300. The fixing device 300 includes a fixing unit 30*e* and a control unit 7. The fixing unit 30*e* has the same configuration as the above-described fixing unit. The control unit 7 has the same configuration as the control unit 5. The fixing device 300 having such a hardware configuration achieves the functions, i.e., a control section 101*e* and a fixing section 102*e*, as shown in FIG. 17B. These sections achieve the same functions as those achieved by the above-described sections having the same name.

Furthermore, the present invention may also be understood as a processing method for achieving processing performed by an image forming system. The processing as used herein is, for example, the adhesion prevention processing shown in FIG. 5 etc. Furthermore, the present invention may also be understood as a program for making a computer, such as an image forming system, function as the sections shown in FIG. 4 etc. This program may be provided in the form of a recording medium, such as an optical disc, that stores the program or by allowing a computer to download through a network such as the Internet and install to be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing section that includes rotatable members arranged to form a nip area through which a strip-shaped medium passes, and heaters that heat the rotatable members; and a control section, wherein the fixing section applies heat and pressure to a toner image that is formed on the medium and passes through the nip area via the rotatable members heated by the heaters to fix the toner image onto the medium, wherein the medium has softenable layers, and wherein the control section performs such control that the rotation of the rotatable members is stopped when the temperature of contact portions of the rotatable members that are in contact with the medium is lower than or equal to a first temperature that is lower than a temperature at which a portion of the medium softens, the temperature at which the portion of the medium softens being a temperature at which at least one of the softenable layers softens.

2. The fixing device according to claim 1, wherein the medium has the softenable layers on a surface thereof, and wherein the first temperature is a temperature that is lower than a temperature at which the at least one softenable layer of the medium softens.

3. The fixing device according to claim 1, wherein, after the toner image is fixed onto the medium, the control section controls a transport device, which transports the medium, to reduce a transport speed at which the medium is transported or repeatedly reverse a transport direction in which the medium is transported.

4. The fixing device according to claim 1, wherein the control section changes the first temperature depending on the degree to which the medium adheres to the rotatable members.

5. A fixing device comprising:

a fixing section that includes rotatable members arranged to form a nip area through which a strip-shaped medium passes, and heaters that heat the rotatable members; and a control section, wherein the fixing section applies heat and pressure to a toner image that is formed on the medium and passes through the nip area via the rotatable members heated by the heaters to fix the toner image onto the medium, wherein the medium has softenable layers, and wherein the control section performs such control that the rotation of the rotatable members is started when the temperature of contact portions of the rotatable members that are in contact with the medium is higher than or equal to a second temperature that is higher than or equal to a softening temperature at which a portion of the medium softens, the softening temperature being a temperature at which at least one of the softenable layers softens.

6. The fixing device according to claim 5, wherein the medium has the softenable layers on a surface thereof, and wherein the second temperature is higher than or equal to a temperature at which the at least one softenable layer of the medium softens.

7. The fixing device according to claim 5, wherein, after the temperature of the contact portions has reached or exceeded the second temperature, the control section controls the transport device, which transports the medium, to gradually increase the transport speed at which the medium is transported.

8. The fixing device according to claim 5, wherein, after the temperature of the contact portions has reached or exceeded the second temperature, the control section controls the transport device to repeatedly reverse the transport direction in which the medium is transported.

9. The fixing device according to claim 5, wherein the control section changes the second temperature depending on the degree to which the medium adheres to the rotatable members.

10. The fixing device according to claim 1, wherein the fixing section does not have a separating device that separates the rotatable members and the medium.

11. The fixing device according to claim 1, wherein the fixing section includes a separating device that separates the rotatable members and the medium, and an insertion member that is to be inserted into or refracted from a space between the rotatable members and the medium, which space is created by the separating device, and wherein the control section inserts the insertion member into the space when the rotation of the rotatable members is completed, and retracts the insertion member from the space when the rotation of the rotatable members is started.

12. The fixing device according to claim 11, wherein the insertion member has lower thermal conductivity, higher thermal resistance, or greater specific heat than the rotatable members.

13. A fixing device comprising:

a fixing section that includes rotatable members arranged to form a nip area through which a strip-shaped medium passes, and heaters that heat the rotatable members; and a control section, wherein the fixing section applies heat and pressure to a toner image that is formed on the medium and passes through the nip area to fix the toner image to the medium via the rotatable members heated by the heaters, wherein the medium has softenable layers, and wherein the control section controls the fixing section to perform an operation for preventing one or more of the softenable layers of the medium heated by the heat of the rotatable members that have stopped upon the completion of the fixing from softening, peeling off, and adhering to the rotatable members.

14. An image forming apparatus comprising:

the fixing device according to claim 1;

a transport device that transports a strip-shaped medium; and a forming device that forms a toner image on the medium transported by the transport device.

15. The fixing device according to claim 6, wherein, after the temperature of the contact portions has reached or exceeded the second temperature, the control section controls the transport device, which transports the medium, to gradually increase the transport speed at which the medium is transported.

* * * * *